US005758625A

United States Patent [19]

Ponti

[11] Patent Number: 5,758,625

[45] Date of Patent: Jun. 2, 1998

[54] METHOD OF SYNCHRONIZING AN INTERNAL-COMBUSTION ENGINE WITHOUT A CAM POSITION SENSOR

[75] Inventor: Cesare Ponti, Avigliana, Italy

[73] Assignee: C.R.F. S.C.P.A., Turin, Italy

[21] Appl. No.: 760,637

[22] Filed: Dec. 4, 1996

[51] Int. Cl.[6] ..... F02D 41/06; F02M 51/00

[52] U.S. Cl. ..... 123/476; 123/491

[58] Field of Search ..... 123/491, 414, 123/643, 436, 492, 476, 419, 422, 424; 73/116

[56] References Cited

U.S. PATENT DOCUMENTS

| | | | |
|---|---|---|---|
| 4,069,795 | 1/1978 | Long et al. | 123/32 EA |
| 4,515,131 | 5/1985 | Suzuki et al. | 123/491 |
| 4,846,131 | 7/1989 | Uchinami et al. | 123/479 |
| 4,870,587 | 9/1989 | Kumagai | 364/431.07 |
| 4,889,094 | 12/1989 | Beyer et al. | 123/414 |
| 4,998,522 | 3/1991 | Achleitner | 123/491 |
| 5,056,360 | 10/1991 | Dosdall et al. | 73/116 |
| 5,174,267 | 12/1992 | DeBiasi | 123/643 |
| 5,515,281 | 5/1996 | Palazzetti et al. | 364/431.08 |
| 5,562,082 | 10/1996 | Norppa et al. | 123/424 |

FOREIGN PATENT DOCUMENTS

| | | |
|---|---|---|
| 0640762 | 3/1995 | European Pat. Off. . |
| 0684375 | 11/1995 | European Pat. Off. . |
| 0684376 | 11/1995 | European Pat. Off. . |
| 2692623 | 6/1992 | France . |
| 4229773 | 3/1994 | Germany . |
| 01195975 | 8/1989 | Japan . |

*Primary Examiner*—Willis R. Wolfe
*Assistant Examiner*—Hieu T. Vo
*Attorney, Agent, or Firm*—Sughrue, Mion, Zinn, Macpeak & Seas, PLLC

[57] ABSTRACT

A method of generating a phase signal over 720° for an internal-combustion engine comprises a multi-point electronic injection system operating sequentially, permitting firing in only some of the cylinders during the starting stage and detecting the angular position in which the first firing occurs.

17 Claims, 9 Drawing Sheets

METHOD OF SYNCHRONIZING AN INTERNAL-COMBUSTION ENGINE WITHOUT A CAM POSITION SENSOR

BACKGROUND OF THE INVENTION

The present invention relates in general to methods of synchronizing internal-combustion engines, particularly internal-combustion engines for motor vehicles, without cam position sensors.

More specifically, the present invention relates to a method of generating a phase signal representative of the operation of the various cylinders of an internal-combustion engine. This signal is intended to be supplied as an input to an electronic fuel-injection system.

At the moment, most internal-combustion engines for vehicles are supplied by fuel-injection systems controlled by electronic control units which, in the case of petrol engines, normally also control ignition. Many current systems have an angular datum specified relative to the 360° of the engine shaft and not to the 720° of the entire engine cycle (in the case of a four-stroke, four-cylinder engine which, moreover, is the most widespread model currently in production).

In recent years, various electronic fuel-injection systems have been developed for internal-combustion engines. Among these, so-called single-point injection systems, which are characterized in that they comprise a single fuel injector disposed in the common air-inlet duct, and so-called multi-point systems, which are characterized in that they comprise a fuel injector for each cylinder of the engine disposed, in particular, in the air-inlet duct of each cylinder, may be mentioned. Multi-point injection systems, to which the present invention relates, are becoming ever more widespread since they improve the operation of internal-combustion engines both from the point of view of performance and from the point of view of pollutant emissions.

Multi-point injection systems typically operate Intermittently, that is, the injectors are opened periodically, at least once per engine cycle. There are basically two methods of operating the injectors: simultaneous operation, in which all of the injectors are opened and closed simultaneously, and sequential operation, in which the injectors are opened and closed individually.

The injection system is typically controlled by an electronic or central control unit which also controls ignition and thus provides for the overall control of the internal-combustion engine. In the case of simultaneous operation, also known as full-group operation, the electronic control unit calculates the amount of fuel to be injected and thus operates all of the injectors simultaneously. This operation may take place once or twice per engine cycle (two revolutions of the engine shaft in the case of a four-stroke engine). This solution simplifies the structure of the electronic control device which controls the injectors since only one power stage is necessary.

However, the full-group method of operation has technical disadvantages. The first disadvantage is due to the fact that, in at least one cylinder, fuel-injection always takes place when there is an inlet valve in the open position. In general, this means that firing takes place in the cylinder in a degenerate or in any case non-optimal manner and this in turn means that more pollutants are produced. Moreover, if rapid transitions occur in the operating conditions of the engine, the electronic control unit has to wait for the end of the engine cycle, which comprises two revolutions of the engine shaft, before it can modify the quantity of fuel to be injected, even though its calculation speed would allow it to react much more quickly.

The sequential method of operation, on the other hand, consists of the injection of the desired amount of fuel for each cylinder in the optimal phase relationship with the induction stroke in the cylinder. Injection thus takes place for each individual cylinder in a time interval preceding the opening of the inlet valve of that cylinder.

The sequential method of operation achieves better results in terms of pollutant emissions. This is because the timing and duration of the injection can be controlled precisely for each cylinder so that the fuel-injection takes place in optimal manner for each cylinder. Moreover, the electronic control unit can react to variations in the operating conditions much more quickly than with the full-group method. This means that the conditions in which firing takes place in each individual cylinder are always almost optimal. The performance of the engine can thus also be improved.

Naturally, this involves a greater cost of the electronic device for controlling the injectors which, in this case, requires a power stage for each injector so that these can be operated independently of one another.

Moreover, a multi-point electronic injection system which operates sequentially requires additional information in comparison with the full-group method, that is, precise information relating to the phases of the cylinders. In fact it is clearly necessary to know the phase of each cylinder precisely so as to be able to inject fuel correctly for that cylinder. In systems operating by the full-group method, this is, of course, not necessary since injection takes place simultaneously for all cylinders.

For example, in the conventional case of a four-cylinder, four-stroke engine, for each engine cycle (720°) there are four top dead centres spaced from one another by 180°. For each revolution of the engine shaft (360°) there are therefore two top dead centres which can easily be distinguished from one another if, as is typical, a phase datum on the engine shaft is used.

For each top dead centre of each revolution of the engine shaft, two of the cylinders are therefore in the top dead centre position while the other two are in the opposite position, that is, in the bottom dead centre position. At a given top dead centre position, it is therefore known, for example, to the electronic injection system, that cylinders 1 and 4 are in the top dead centre position, while cylinders 2 and 3 are in the bottom dead centre position. With a datum relating only to the 360° of the engine shaft, however, the system cannot know if cylinder 1 is in the compression phase and cylinder 4 is consequently in the exhaust phase, or if cylinder 4 is in the compression phase and cylinder 1 is consequently in the exhaust phase. To provide this information it is necessary, as stated above, to have a datum specified in relation to the 720° of the engine cycle.

The use of sensor devices associated with a camshaft of the engine is known for obtaining this datum. In fact, it is known that, since the camshaft or camshafts of the engine rotate at half of the speed of rotation of the engine shaft, they can provide a datum relating to the 72°.

However, these sensors have the disadvantage of being very complex and difficult to install with consequent increases in the cost and complexity of the electronic infection system. It is much easier, on the other hand, to provide the engine with a phonic wheel which, typically, has a large number of teeth and is associated with the engine shaft, and which provides a datum specified in relation to the 360° of rotation of the engine shaft at low cost.

In the case of the camshaft, however, it is typically not possible, for reasons of space, to install a phonic wheel having a large number of teeth so that the sensor associated with the camshaft is often used in combination with the conventional phonic wheel associated with the engine shaft, solely to give the phase datum, that is, to discriminate between the two revolutions of the engine shaft which make up the engine cycle.

To avoid this problem, a solution known in the art is to use a cam sensor associated with a wheel having four teeth so as to have data over 720° and corresponding to the top dead centre positions of the four cylinders of the engine. It is thus possible to do without the phonic wheel and its sensor. This solution has the disadvantage, however, of not enabling data to be acquired during transitions between one top dead centre position and the next since, owing to dimensional constraints, it is not possible to use a wheel having a large number of teeth associated with a camshaft. This means that this solution does not enable the engine to be controlled efficiently during transitions.

This means that, up to now, injection systems which can detect the phases of the cylinders are substantially more expensive than injection systems which are limited to detecting the datum relating one revolution of the engine shaft.

To avoid this problem, it was proposed in French patent application No. 2 692 623, filed on 23rd June 1992, to use a method which can determine the precise phase of the engine cycle from the data available with a datum specified In relation to the 360° of rotation of the engine shaft. This method provides for the engine to be started, not necessarily in phase (there is a 50% chance that the phase will be inverted), until the engine is brought to running speed. The injection of fuel is then stopped for a given reference cylinder, for example, cylinder number 1, for a predetermined period of time. Naturally, this causes one or more misfires in cylinder Since phonic wheels associated with engine shafts typically comprise large numbers of teeth, it is possible to detect variations of speed and accelerations of the engine shaft almost instantaneously. The electronic control unit can thus detect misfires in one of the cylinders since the corresponding acceleration imparted to the engine shaft by the firing is lacking. It is thus possible to ascertain the phase of the engine cycle, since the misfiring occurs during the engine revolution in which cylinder I is in the expansion phase. The electronic control unit can then control injection sequentially.

However, this method also has technical disadvantages. A first disadvantage is due to the fact that the starting stage takes place in an untimed manner until the phase is identified. The firing which takes place during the initial stage of operation of the engine is thus not optimal, resulting in pollutant emissions. It is known that the initial stage of operation of the engine is the stage in which most pollutants are produced. Limitation of pollutant emissions is therefore particularly important during this initial operating stage and, moreover, is necessary in order to pass certain tests such as, For example, the tests which are carried out according to the so-called ECE standards to determine the emission of pollutants by the engine and which are required by anti-pollution laws.

A second disadvantage is due to the fact that, when the engine has just been started, in adverse conditions, misfiring which is not caused by the control unit may in any case occur and may falsify or prolong the phase identification. Identification may also be rendered difficult by the fact that, with the engine started, the signal/noise ratio of the phonic wheel signal is not very high so that any interference may compromise the identification of misfires.

A further disadvantage is that the user of the vehicle may set the vehicle in motion before the system has succeeded in acquiring the correct timing.

SUMMARY OF THE INVENTION

The object of the present invention is to provide a synchronization method which solves all of the problems indicated above in a satisfactory manner.

According to the present invention, this object is achieved by means of a synchronization method having the characteristics indicated In the claims which follow the present description.

BRIEF DESCRIPTION OF THE DRAWING

Further advantages and characteristics of the present invention will become clear from the following detailed description, given with the aid of the appended drawings, provided by way of non-limiting example, in which.

DETAILED DESCRIPTION OF THE INVENTION

In a first embodiment, the present invention is based essentially on a method for identifying the phase of the engine cycle in the shortest possible time so as to enable the engine to operate according to the sequential, timed method from the very first seconds of the engine's operation. This method also enables the phase of the engine cycle to be identified without the use of any specific additional sensor.

The method according to the invention provides for the internal-combustion engine to be started, firing being permitted in only one cylinder or in only some of the cylinders of the internal-combustion engine. During starting, the electronic control unit identifies the first firing which takes place inside one of the cylinders by analysing the signals generated by a phonic wheel associated with the engine shaft. The cylinders in which firing is permitted during the starting phase are selected in a manner such that firing taking place in one of them enables the phase of the engine cycle to be identified with certainty if a datum relating to the 360° of rotation of the engine shaft is available.

Figure 1:
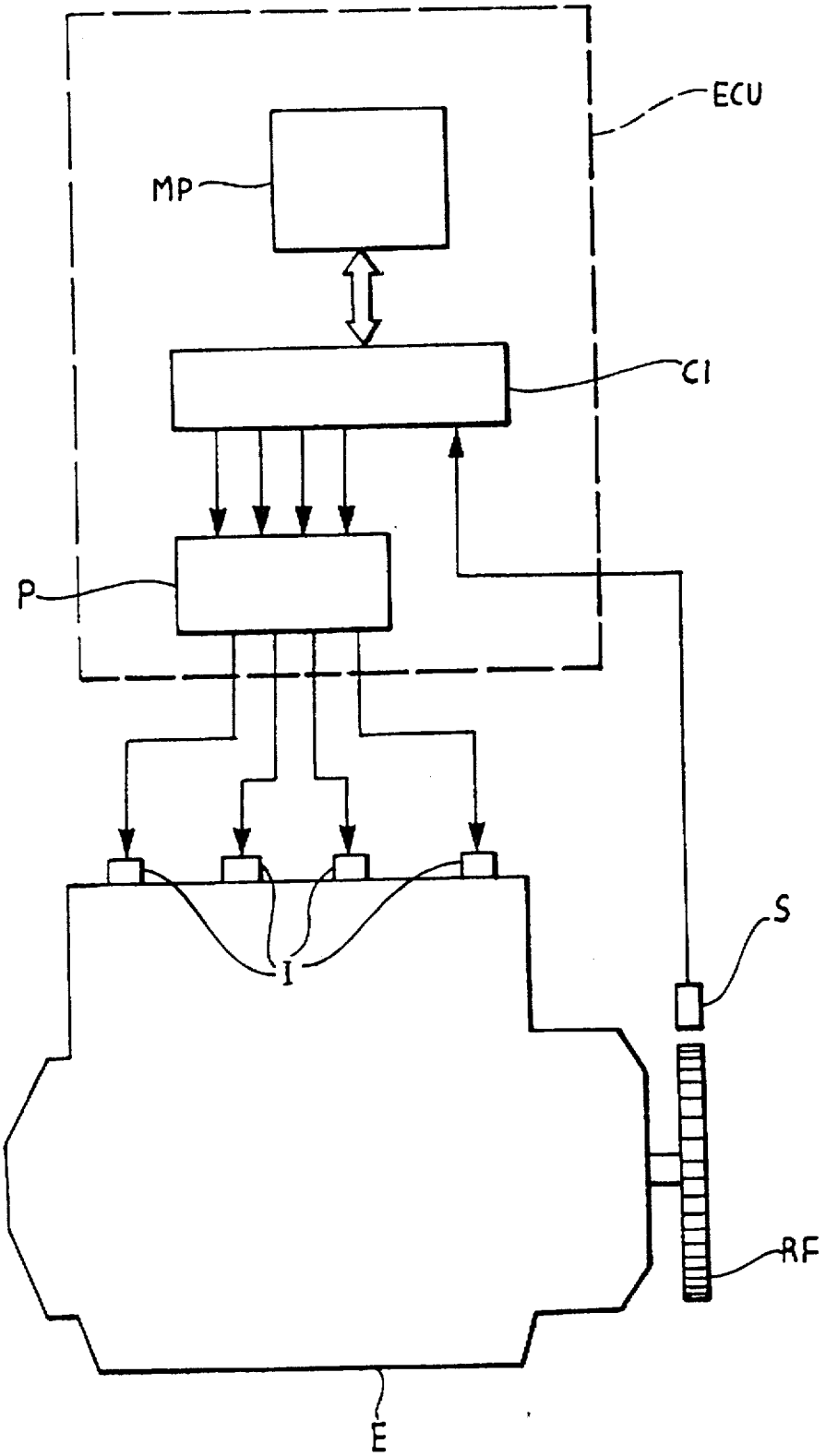
FIG. 1 is a schematic block diagram of an electronic fuel-injection system which can implement the method according to the invention, and FIGS. *2a*, *2b*, *3a*, *3b*, *4a*, *4b*, *5a*, *5b* are graphs illustrating aspects of the operation of the method according to the invention.

For a better understanding, a multi-point electronic injection system which can operate in a sequential, timed manner and with which a method according to the present invention can be used will now be described with reference to FIG. 1.

The system is controlled by an electronic control unit ECU which controls both the fuel injection and the ignition of a four-cylinder internal-combustion engine E. The electronic control unit ECU comprises an electronic microprocessor or processor MP which processes data relating to the operation of the engine E, picked up by sensors associated with the engine A, and outputs control signals for controlling fuel injection and ignition in the engine E.

For this purpose, the electronic control unit ECU has an interface device CI for communication between the microprocessor MP and devices outside the electronic control unit ECU. One of the functions of the interface device CI is to convert the signals picked up by the sensors associated with the engine E into a format acceptable to the microprocessor MP.

One of these sensors is a sensor S, typically an electromagnetic sensor, cooperating with a phonic wheel RF associated with the shaft of the engine E The phonic wheel RF typically comprises a large number of teeth, for example, from 60 to 135 teeth, and also includes an angular datum such as, for example, one or two missing teeth, so that a datum specified in relation to the 360° of rotation of the engine shaft can be acquired. The method according to the invention may, however, also be used when a phonic wheel with a small number of teeth is available. Naturally, the signals generated by the sensor S are sent to the interface device CI connected to the microprocessor MP.

The control signals output by the microprocessor MP for controlling injection are also transmitted to the interface device CI which in turn sends them to a power stage P. The power stage P controls the four injectors I of the internal-combustion engine E.

Naturally, the electronic injection system includes further sensors and devices which are not shown since they are not relevant for the purposes of a description and an understanding of the present invention. Moreover, the components described up to now are not described in greater detail since they are conventional components currently in use on numerous electronic injection systems and can therefore be formed without difficulty by an expert in the art.

The method according to the invention will now be described in detail by the provision or examples relating to a conventional four-stroke, four-cylinder engine. It is assumed that, when the engine is started, fuel is injected into all four cylinders in an untimed manner in wholly conventional manner, for example, as in the case of an electronic control unit operating by the full-group method. The electronic control unit ECU can detect almost instantaneously the speed and the acceleration of the engine shaft (naturally these are the angular velocity and acceleration) which are shown in the cartesian graphs of FIGS. 2*a* and 2*b*, respectively.

Figure 2A:
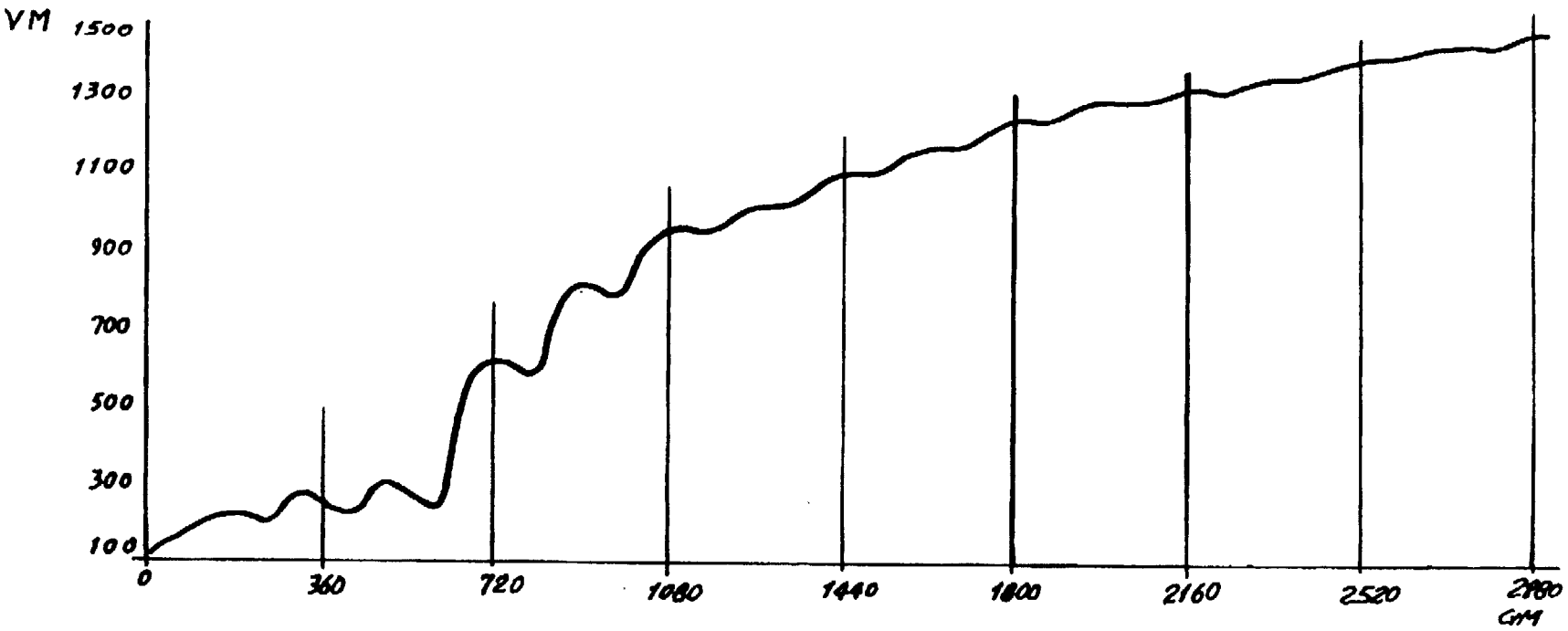

In the graph of FIG. 2*a*, engine degrees GM or, in practice, the rotation of the engine shaft, is shown on the abscissa and the speed of the engine shaft VM is shown on the ordinate (in revolutions per minute). Similarly, in FIG. 2*b*, the engine degrees GM are shown on the abscissa and the torque CM applied to the engine shaft is shown on the ordinate. The torque CM can easily be derived from the acceleration imparted to the engine shaft or, alternatively, the acceleration of the engine shaft may be used directly instead of the torque CM and may be obtained, for example, by differentiation of the velocity VM.

Naturally, if it simplifies the calculation procedures in the microprocessor MP, the speed VM of the engine shaft may be used, or the time intervals elapsing between the detections of the top dead centre positions of the cylinders of the engine may be used directly. The latter are in fact obtained directly from the phonic wheel signal.

In order to identify the first firing, known techniques such as, for example, the use of a predetermined threshold relating to the quantity (speed, acceleration, time intervals, etc.) used for the identification may be used. This threshold may also be variable, for example, in dependence on the speed imparted by the starter motor to the engine shaft.

Figure 2B:
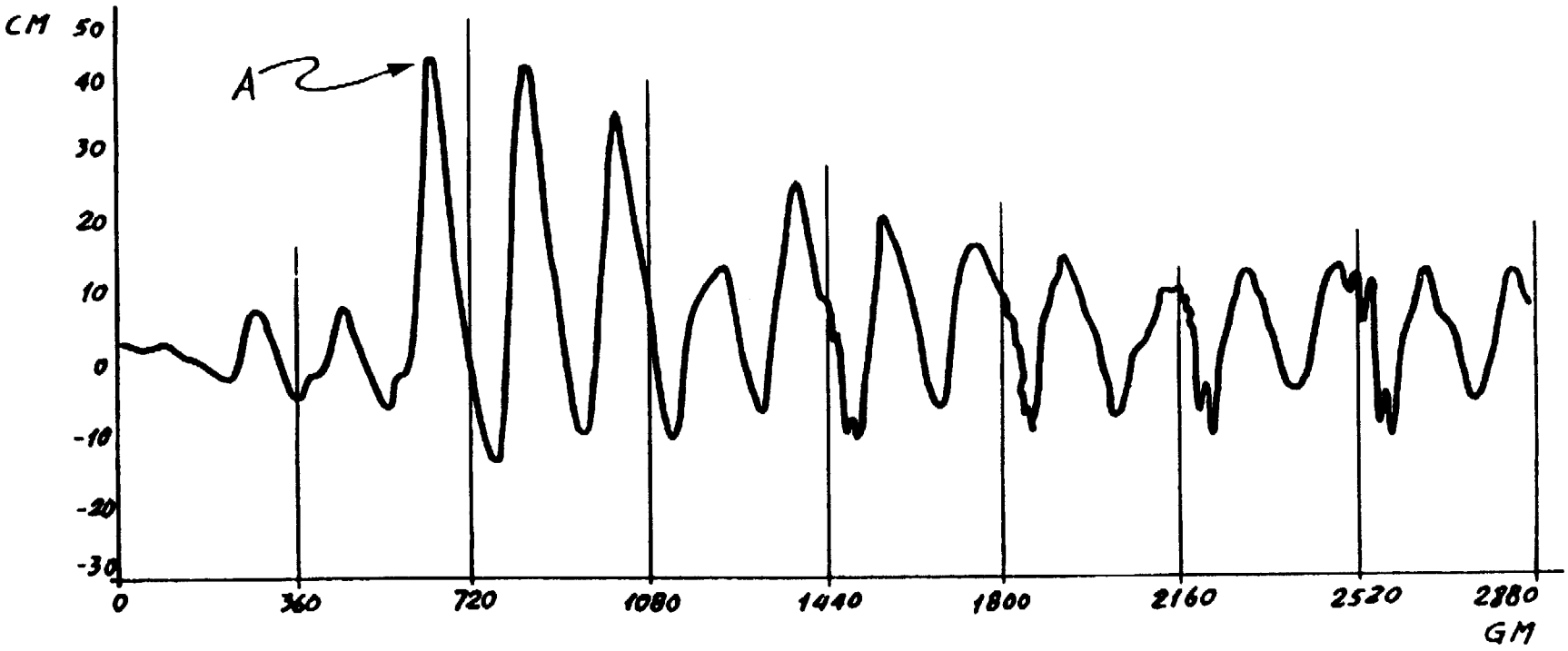

As can be seen from FIG. 2*b*, the first firing which occurs in one of the cylinders of the engine E can easily be detected since it imparts a considerable acceleration and torque pulse to the engine shaft. It is pointed out that, during the starting stage, before the first firings occur, the engine shaft rotates at a low speed since it is driven solely by the starter motor which also has to overcome the resistance due to the greater initial viscosity of the oil.

For a better understanding, the peak corresponding to the first firing is indicated A in the graph of the engine torque CM. As can be seen from the graph, this peak A occurs shortly before the engine shaft has rotated through 720°. Moreover, it can be seen from the speed graph of FIG. 2*a* that there is also a definite increase in the speed VM of the engine shaft corresponding to the peak A, in comparison with the period in which there were not yet any firings. When the engine has started normally, it can be seen that the torque peaks are of lower amplitude.

This demonstrates a problem of the method of the prior art described above. In fact, when the engine has started normally, the lower amplitude of the torque peaks makes it more difficult to identify the phase, the signal/noise ratio is not high and may also be altered by interference present in the signal detected by the sensor S. Moreover, the method of the prior art is further complicated by the fact that, in certain conditions which make it difficult to start the engine E, for example, a very low temperature, misfiring may occur and, naturally, may cause incorrect phase determination. For example, in the graph of FIG. 2*b*, it can be seen that the fourth firing, shortly after the engine has rotated through 1080°, did not take place in optimal manner and therefore generated a torque peak of lower amplitude. This means that, with the use of this method, the phase identification takes a fairly long time during which the engine operates with untimed injection and with the consequent emission of a larger quantity of pollutants.

Figure 3A:
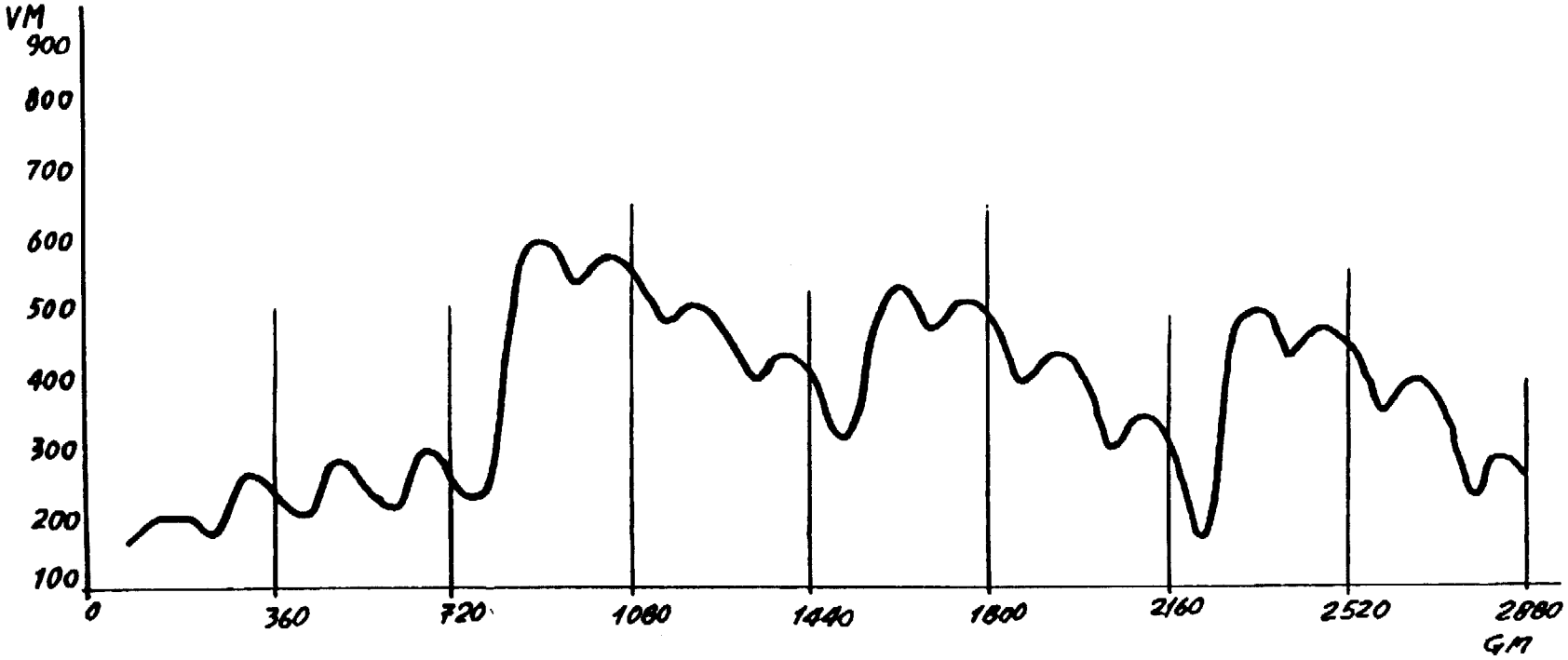
Figure 3B:
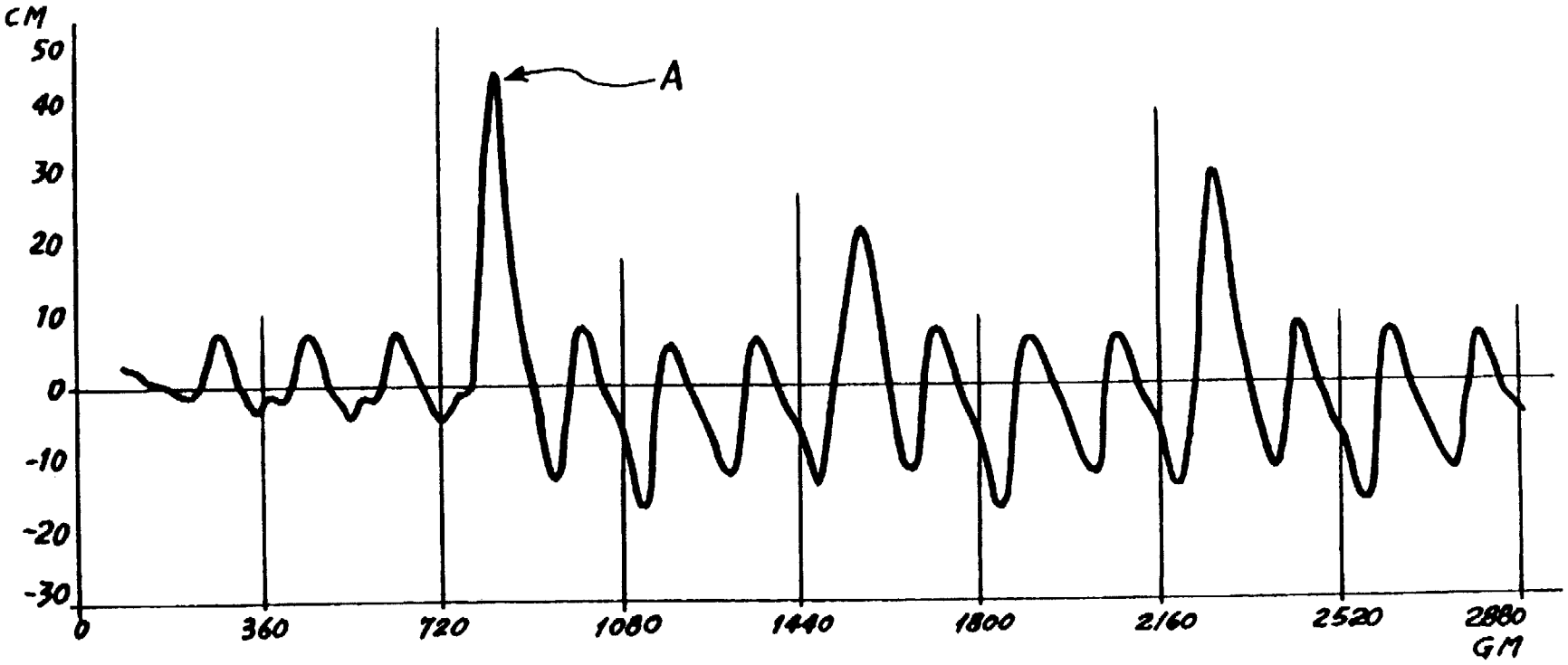
Figure 4A:
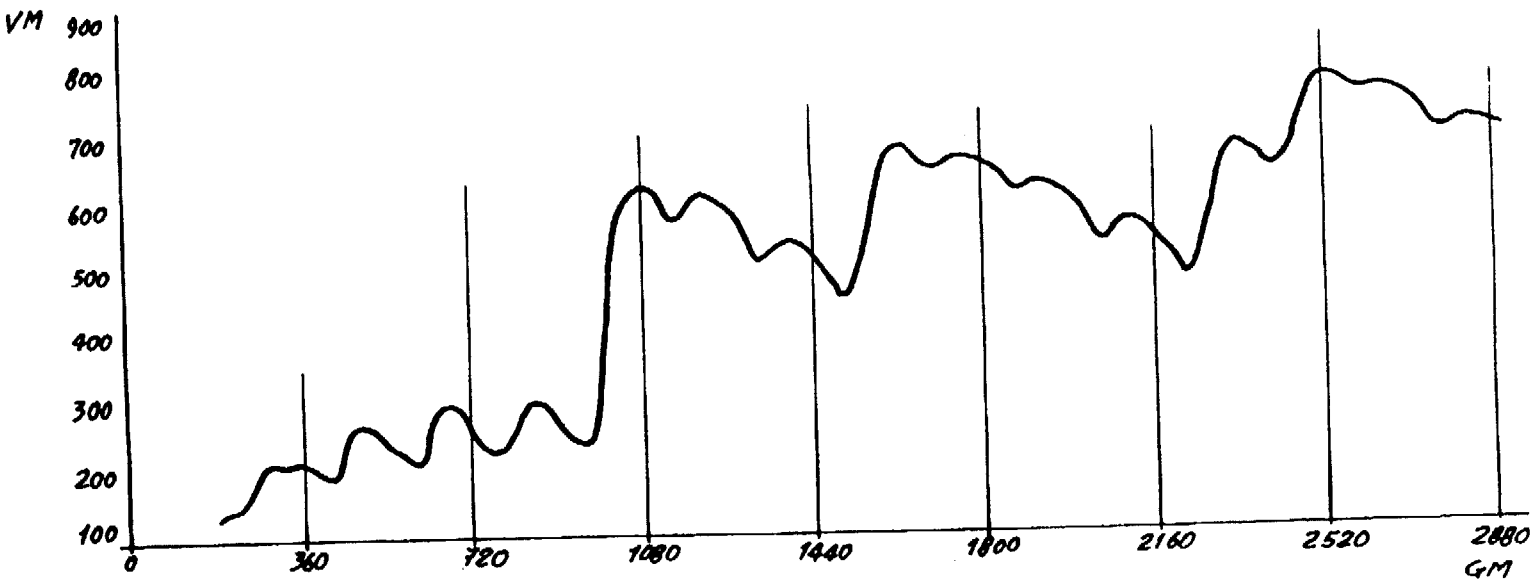
Figure 4B:
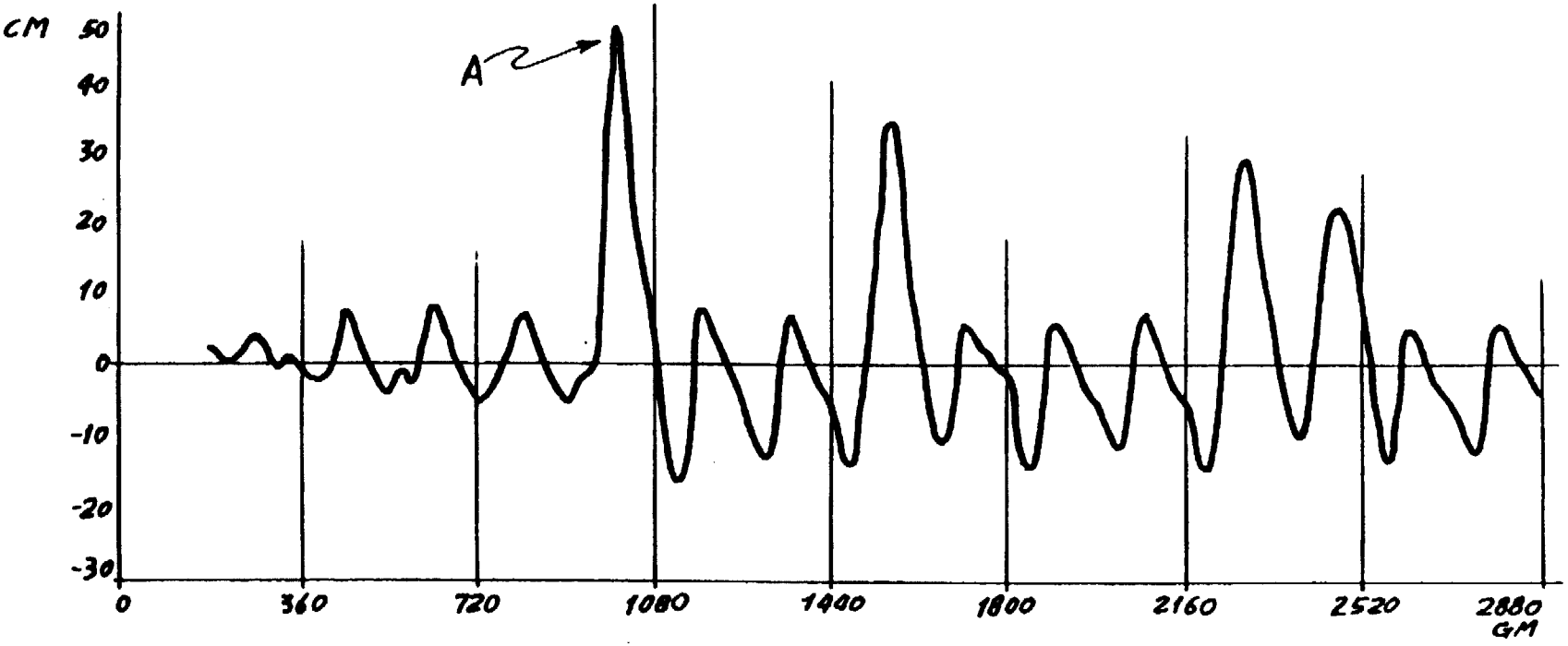
Figure 5A:
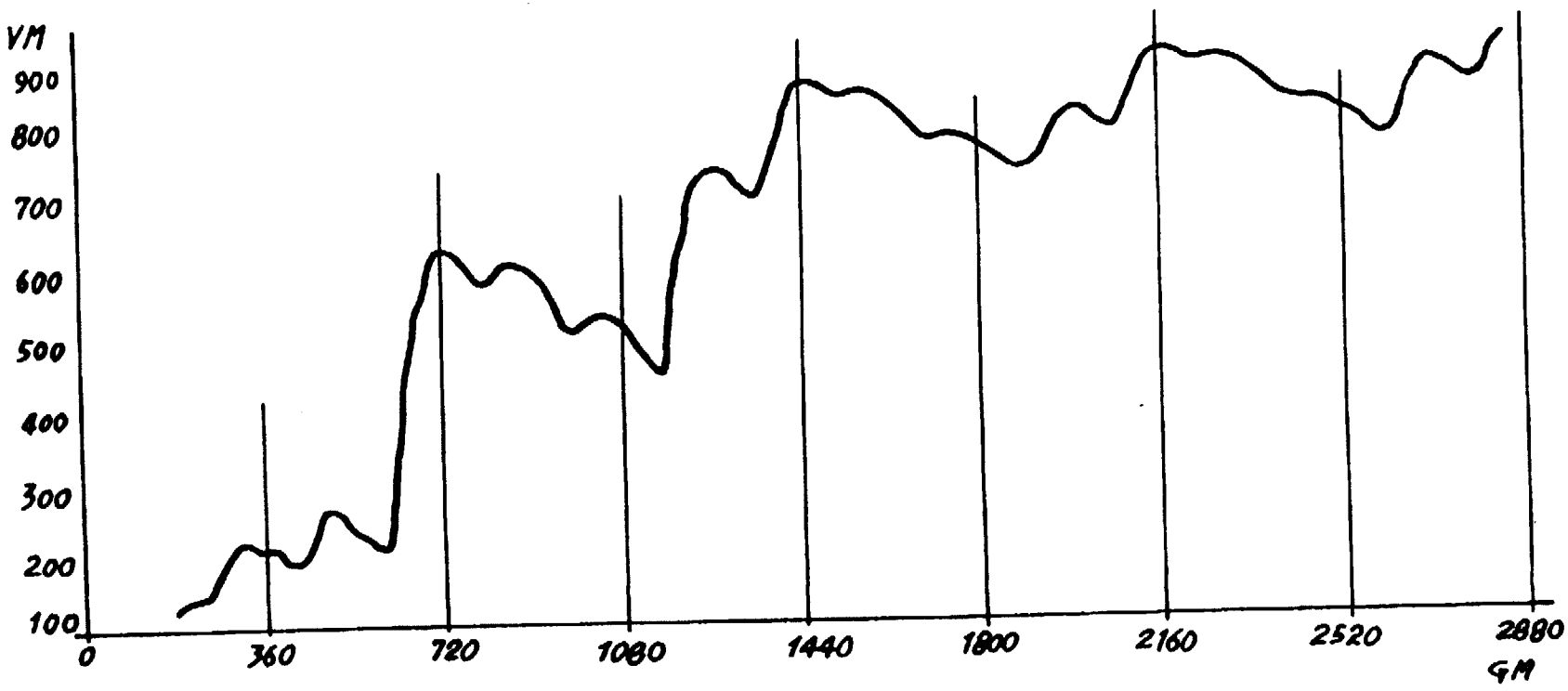
Figure 5B:
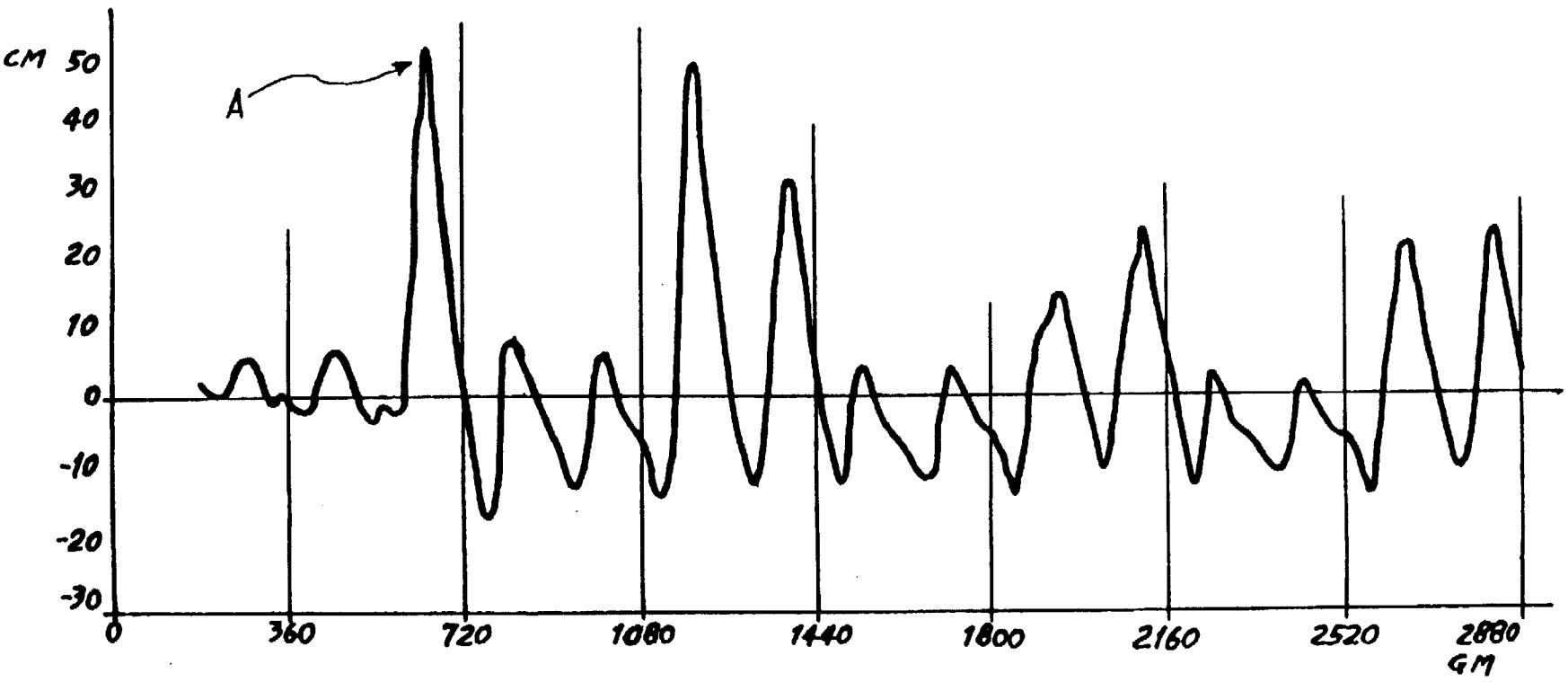

It is assumed, however, that a method according to the present invention is used. In this case, it is possible, for example, to inject fuel solely into cylinder 1, naturally in an untimed manner. It is thus absolutely certain that the first firing which occurs in the engine E occurs in cylinder 1, naturally when it is in the compression phase. This situation is shown, for example, in the graphs of FIGS. 3*a* and 3*b*. As can clearly be seen in FIG. 3*b*, the peak A corresponding to the first firing taking place in cylinder 1 is easily identifiable. Naturally, this enables the engine phase to be identified with absolute certainty.

The method according to the invention thus offers considerable advantages because it enables the engine phase to be identified extremely quickly since it suffices to await the first firing which occurs in the preselected cylinder. It is then possible immediately to start timed injection in all of the cylinders of the engine, thus enabling the engine to start in optimal conditions.

As can be noted from the graphs, the identification of the peak A corresponding to the first firing is also very easy and, moreover, is facilitated by the fact that the first firing occurs when the engine is still driven by the starter motor. This means that, in these conditions, the engine shaft is rotating at a fairly low speed, typically between 200 and 300 revolutions per minute and the signal detected by the sensor S consequently has a low frequency which means that it has a high signal/noise ratio, is less subject to interference, and can easily be processed by the electronic control unit ECU. Moreover, the first firing imparts to the engine shaft a torque and acceleration pulse having an amplitude considerably greater than the oscillations caused by the starter motor, which makes it very recognizable.

Some methods usable for the detection and identification of the torque pulse imparted by the first firing which occurs in the engine E are known in the art. For example, the Applicant's U.S. patent application Ser. No. 5515281 describes a method for the dynamic measurement of the torque in a shaft of an internal-combustion engine. A person skilled in the art can easily produce an electronic control unit ECU implementing the method according to the present invention by means of one of these methods for the identification of the first firing which occurs in the engine E.

The method according to the invention can also be implemented in a manner such that two or three firings in the permitted cylinders are awaited, in addition to the first, so as to have an extremely high degree of safety in, the phase identification, although it has in fact been found that the detection of the first firing already permits reliable chase identification. In any case, identification also takes place in a very short time in this case.

Naturally, the principle upon which the method is based can be generalized. For example, it is possible to carry out injection in two cylinders instead of only one during starting. This is possible since, with the injection of fuel into a pair of cylinders which do not have the same top dead centre, it is still possible to identify the engine phase with absolute certainty when the first firing occurs. Thus, if it is decided, for example, to inject fuel into the pair of cylinders 1–3 (which are consecutive in the firing sequence), selected in a manner such that, when cylinder 1 is at top dead centre, cylinder 3 is at bottom dead centre, the phase of the engine cycle can be identified with certainty. In fact, when the first firing is detected, of course, only one of the two cylinders 1 and 3 is at top dead centre and can thus be responsible for the firing.

This situation is shown in FIGS. *4a*, *4b* and *5a*, *5b*. As can be seen, for example, in graph *5b*, the first torque peak A indicates the first firing taking place and is situated shortly before 720° of rotation. In the next engine revolution, firing occurs in both of the cylinders into which fuel is injected. As can be seen from the graph (during the revolution of the engine from 1080° to 1440°) one of the two cylinders causes firing and hence a torque peak in the first half of the revolution of the engine shaft, whereas the other of the two cylinders causes firing and hence a torque peak in the second half of the revolution of the engine shaft. Moreover, in half of the revolutions, for example, the revolutions from 720° to 1080° or from 1440° to 1800° there is no firing since no cylinders in which firing is permitted are in the compression stage. Clearly, this enables the phase to be identified reliably from the first firing A which occurs.

This method has the advantage that, if fuel is injected into two cylinders, there is a greater probability of firing occurring in the first revolutions of the engine shaft during the starting stage. Phase identification thus takes place in the shortest possible time, after which it is possible to start timed fuel injection. This is particularly important, of course, when starting takes place in difficult conditions so that misfiring may occur during the initial revolutions of the engine shaft.

Thus, for example, in a four-cylinder engine in which the firing sequence in the cylinders is 1-3-4-2, firing may be permitted in a pair of cylinders firing consecutively in the sequence. In this case, the cylinders in which firing may be permitted in order to determine the phase of the engine cycle are 1-3, 4-2, 2-1, 3-4 which are all of the possible pairs of cylinders which fire consecutively in the sequence given.

Naturally, the method according to the invention can also be applied to engines of other types. Thus, in a twocylinder engine, obviously firing is permitted in only one cylinder. In a six-cylinder engine firing is permitted, for example, in three consecutive cylinders in the firing sequence, or possibly in a smaller number of cylinders. In practice, it is found that the method can be applied to all engines in which the phase of the engine cycle cannot be determined with a datum relating to 360°.

In the case of engines such as, for example, threecylinder or five-cylinder engines in which all of the too dead centres of the various cylinders are different, naturally, it suffices to detect solely the first firing in order to determine the phase with certainty. With these engines, it is therefore unnecessary to inject fuel into only some of the cylinders of the engine.

Naturally, the method can also be implemented by injecting fuel into all of the cylinders of the engine and bringing about ignition only in the preselected cylinders so as to permit firing solely in those cylinders. This method is entirely equivalent for the purposes of the determination of the engine phase but has the disadvantage, in comparison with the method described previously, of involving the injection of more fuel which is destined not to be burnt during the first revolutions in the starting stage.

In a second embodiment, the method according to the invention provides for firing to be permitted in all of the cylinders each time starting takes place, until the rate of rotation of the engine shaft exceeds a predetermined value (the cranking stage), this value preferably being below the rate of rotation at idling speed. When this angular velocity value is exceeded, firing is then permitted in only some of the engine cylinders, which are selected by the criteria described above, and the first firing which occurs in one of the cylinders in which firing is permitted is detected, etc., as in the first embodiment of the method described above.

The second embodiment of the method according to the invention also enables the phase of the cylinders to be identified before the engine, which has just started, reaches and stabilizes at idling speed. Phase identification thus takes place when the signal/noise ratios are still quite high since the engine is still in the rapid acceleration stage following cranking.

Naturally, the principle of the invention remaining the same, the details of construction and forms of embodiment may be varied widely with respect to those described and illustrated, without thereby departing from the scope of the present invention.

What is claimed is:

1. A method of synchronizing an Otto-cycle internal-combustion engine, the engine having a fuel-supply system controlled by at least one electronic processing unit and sensor means which can provide the electronic unit with a first datum signal indicative of the angular position of the shaft of the engine over 360°, the method being suitable for generating a second datum signal indicative of the phase of operation of at least one cylinder of the engine such that, in combination with the first datum signal, it enables of the angular position of the shaft of the motor to be discriminated over 720°, characterized in that it comprises the steps of:

permitting firing in a sub-group of the cylinders of the engine, the cylinders in which firing is permitted being selected in a manner such that their top dead centres occur in different angular positions of the engine shaft, detecting, by means of the first datum signal, the first firing occurring in one of the cylinders in which firing is permitted, determining the phase of operation of the at least one cylinder on the basis of the angular position of the engine shaft at the moment at which the first firing occurs.

2. A method according to claim 1, characterized in that, in engines in which all of the top dead centres of the cylinders occur in different angular positions of the engine shaft, the sub-group of cylinders in which firing is permitted comprises all of the cylinders of the engine.

3. A method according to claim 2, characterized in that in engines with 3 cylinders and engines with 5 cylinders, the sub-group of cylinders in which firing is permitted comprises all of the cylinders of the engine.

4. A method according to claim 1, characterized in that the cylinders in which firing is permitted fire consecutively in the firing sequence of the engine.

5. A method according to claim 4, characterized in that, in engines having even number of cylinders, the sub-group of cylinders in which firing is permitted comprises at most half of the cylinders of the engine.

6. A method according to claim 1 or claim 5, characterized in that the sub-group of cylinders in which firing is permitted comprises a single cylinder of the engine.

7. A method according to claim 1, characterized in that firing is permitted in the sub-group of cylinders of the engine by the injection of fuel solely into the said sub-group of cylinders.

8. A method according to claim 1, characterized in that firing is permitted in the sub-group of cylinders of the engine by bringing about ignition solely in the said subgroup of cylinders.

9. A method according to claim 1, characterized in that the step of detecting the first firing by means of the first datum signal comprises the step of analysing the time intervals between the detections of the top dead centres of the cylinders, obtained from the first datum signal.

10. A method according to claim 9, characterized in that the step of detecting the first firing comprises the step of detecting, in the signal indicative of the speed, of the acceleration, or of the torque of the engine shaft, a peak having an amplitude substantially greater than the amplitude of a predetermined number of preceding oscillations of the signal indicative of the acceleration or of the torque.

11. A method according to claim 10, characterized in that the step of detecting the first firing comprises the step of detecting, in the signal indicative of the speed, of the acceleration, or of the torque of the engine shaft, a peak having an amplitude greater than a predetermined threshold value.

12. A method according to claim 1, characterized in that the step of detecting the first firing by means of the first datum signal comprises the step of analysing a signal indicative of the speed of the engine shaft, obtained from the first datum signal.

13. A method according to claim 1, characterized in that the step of detecting the first firing by means of the first datum signal comprises the step of analysing a signal indicative of the acceleration of the engine shaft, obtained from the first datum signal.

14. A method according to claim 1, characterized in that the step of detecting the first firing by means of the first datum signal comprises the step of analysing a signal indicative of the torque of the engine shaft, obtained from the first datum signal.

15. A method according to claim 1, characterized in that it comprises the step of detecting, by means of the first datum signal, at least one further firing after the first, occurring in one of the cylinders in which firing is permitted, in order to determine the phase of the at least one cylinder.

16. A method according to claim 1, characterized in that, each time the engine is started, firing is permitted immediately in the aforementioned sub-group of cylinders of the engine.

17. A method according to claim 1, characterized in that, each time the engine is started, firing is initially permitted in all of the cylinders of the engine, until the rate of rotation of the shaft of the engine exceeds a predetermined value, and firing is then permitted solely in the aforementioned sub-group of cylinders of the engine until the phase of the at least one cylinder of the engine is determined.

* * * * *